US011674763B2

(12) United States Patent
Caudle et al.

(10) Patent No.: US 11,674,763 B2
(45) Date of Patent: Jun. 13, 2023

(54) CONTROLLING CYCLE RATE OF FIREARMS

(71) Applicants: Carl E Caudle, Moses Lake, WA (US); Nathanel J Caudle, Moses Lake, WA (US)

(72) Inventors: Carl E Caudle, Moses Lake, WA (US); Nathanel J Caudle, Moses Lake, WA (US)

( * ) Notice: Subject to any disclaimer, the term of this patent is extended or adjusted under 35 U.S.C. 154(b) by 0 days.

(21) Appl. No.: 17/515,434

(22) Filed: Oct. 30, 2021

(65) Prior Publication Data

US 2022/0136787 A1 May 5, 2022

Related U.S. Application Data

(60) Provisional application No. 63/107,742, filed on Oct. 30, 2020.

(51) Int. Cl.
*F41A 3/62* (2006.01)
*F41A 3/86* (2006.01)

(52) U.S. Cl.
CPC . *F41A 3/62* (2013.01); *F41A 3/86* (2013.01)

(58) Field of Classification Search
CPC ..... F41A 3/62; F41A 3/86
USPC ..... 89/129.01, 130, 191.01–192
See application file for complete search history.

(56) References Cited

U.S. PATENT DOCUMENTS

| | | | | | |
|---|---|---|---|---|---|
| 2,981,158 | A * | 4/1961 | Fletcher | F41A 5/26 | 89/192 |
| 3,580,132 | A * | 5/1971 | Vartanian | F41A 5/18 | 42/1.06 |
| 4,409,883 | A * | 10/1983 | Nyst | F41A 5/18 | 89/192 |
| 5,886,281 | A * | 3/1999 | Kirstein | F41A 5/18 | 89/187.01 |
| 6,019,024 | A * | 2/2000 | Robinson | F41A 5/18 | 89/191.01 |
| 6,606,934 | B1 * | 8/2003 | Rock | F41A 11/02 | 89/192 |
| 6,931,978 | B1 * | 8/2005 | Dionne | F41A 3/12 | 89/194 |
| 8,272,314 | B1 * | 9/2012 | Gould | F41A 5/26 | 89/191.01 |
| 2008/0276797 | A1 * | 11/2008 | Leitner-Wise | F41A 5/18 | 89/191.01 |
| 2009/0223357 | A1 * | 9/2009 | Herring | F41A 5/18 | 89/193 |
| 2010/0282065 | A1 * | 11/2010 | Stone | F41A 5/28 | 89/191.02 |
| 2015/0260468 | A1 * | 9/2015 | Foster | F41A 5/26 | 89/191.01 |
| 2018/0031343 | A1 * | 2/2018 | Caudle | F41A 3/86 | |

* cited by examiner

*Primary Examiner* — Bret Hayes

(57) ABSTRACT

A damping assembly for a firearm is provided. The damping assembly includes at least a gas piston and a recoil spring, which may be arranged coaxially or in parallel. The gas piston is disposed within a gas tube which has access to the bore of the firearm through a gas inlet. Pressurized gas from the bore can enter the gas tube via the inlet and push against the gas piston, which can dampen the cycle rate of the firearm.

20 Claims, 9 Drawing Sheets

Prior Art
Example Automatic Firearm

Example Pressure Curves

CONTROLLING CYCLE RATE OF FIREARMS

PRIORITY CLAIM AND CROSS-REFERENCE TO RELATED APPLICATION

This application claims the benefit under 35 U.S.C. § 119(e)(1) of U.S. Provisional Application No. 63/107,742, filed Oct. 30, 2020, which is hereby incorporated by reference in its entirety.

BACKGROUND

Weapons for military and law enforcement use must work reliably under a variety of environmental conditions, often adverse. Sometimes only substandard ammunition is available. Variations in combustion gas pressures resulting from substandard ammunition can affect gas operating systems, including cycle rate consistency.

Further, tight tolerances for moving parts, such as the bolt within the upper receiver of such weapons can lead to jamming or other malfunctions. Thus the tolerances in automatic weapons are often generous enough to provide for proper irrigation of debris. However, generous tolerances permit off-axis movement of parts, such as the bolt, increasing wear of any bearing surfaces. Such wear leads to even greater tolerances and further wear.

Automatic weapons have a high cyclic rate, which exacerbates the problem. A high cyclic rate creates more wear and more debris, which in turn increases off-axis movement of the bolt within the upper receiver housing. Such movement at a high cyclic rate abrades the softer aluminum parts, or other softer materials, of the upper receiver housing.

SUMMARY

This disclosure provides techniques and devices for reliable use of semi-automatic and automatic weapons under varying conditions. Various firearms, including rifles, handguns, and the like are within the scope of the disclosure. The representative implementations of techniques and devices control the cycle rate of the weapons by adding a buffering or damping stage to the recoil action cycle. The cycle rate is the rate at which the firearm reloads in preparation for a subsequent firing after a triggering event through the recoil action cycle. The damping stage includes a gas piston in concert with a recoil spring. The damping stage equalizes the gas forces and slows the opening of the firearm's action, where for the purposes of this disclosure, the action comprises the slide of a handgun style firearm or the bolt of a rifle style firearm. Other recoil components may also be part of the action, where the components assist in the reloading of the firearm. This can help mitigate the effects of substandard ammunition by controlling the cycle rate regardless of the variations in gas pressures presented by the varying ammunition.

Further advantages of the techniques and devices include improved alignment of the bolt and recoil components. Improved alignment results in closer on-axis movement of the components. The improved alignment allows for tighter tolerances when desired and less wear of the upper receiver components with more generous tolerances, even with high cycle rates. Also, assembly and disassembly of the action and recoil components is made easier and more straightforward since the recoil spring is integrated into the novel damping stage assembly.

In some embodiments, a travel stop damper is also incorporated into the recoil damping stage assembly. The travel stop damper eases the impact of the recoil components, lessening wear due to impact and improving the longevity of the components.

BRIEF DESCRIPTION OF THE DRAWINGS

The detailed description is set forth with reference to the accompanying figures. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1:
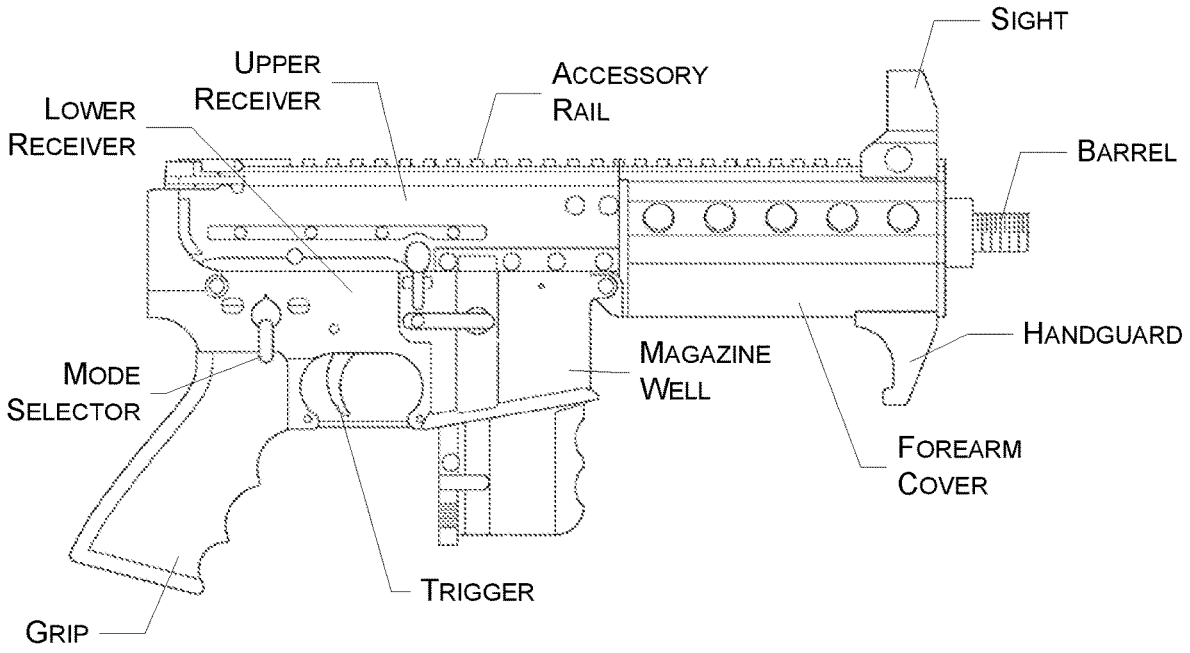
FIG. 1 shows a side view of an example automatic firearm, which is an exemplary environment for the techniques and devices disclosed herein, according to various embodiments.

Representative implementations of devices and techniques provide novel systems for controlling the cycle rate in semi-automatic and automatic firearms, including various handguns, rifles, and the like. One example automatic firearm where the devices and techniques disclosed herein may be implemented is shown at FIG. 1. The example of FIG. 1 is not intended to be limiting, and many other semi-automatic and automatic firearms are also within the scope of this disclosure.

In various embodiments, the novel devices and techniques include a recoil damping assembly that includes recoil and damping functions in a single assembly. The damping assembly includes a gas piston (e.g., a gas tube and a piston within the gas tube) in concert with a recoil spring. The gas piston is pressurized by the expanding combustion gases of a triggering event. The damping assembly can be adjusted or fine-tuned for an amount of damping and cycle timing by altering or adjusting various physical characteristics and attributes of the gas piston, the recoil spring, and the associated components.

The damping assembly controls the cycle rate by buffering or damping the recoil action. For example, the damping assembly equalizes gas forces within the firing chamber and the components of the damping assembly (e.g., the gas piston) to slow the opening of the firearm's action. The damping assembly can regulate the speed and/or the timing of the recoil action cycle, including while taking account of variations in gas pressures due to variations in ammunition used. In some cases, this also lessens the impact of components on each other during cycling, reducing wear.

Due to the arrangement of the damping assembly components and the forces exerted by them, the novel devices and techniques also provide an improved alignment of the components within the upper receiver of the firearm during cycling. The closer on-axis movement of the components lessens the wear of the components and improves their longevity.

Example Embodiments: Recoil Damping Assembly

Referring to FIGS. 2-13, the following part number designations are used throughout:

| Part | Description |
|---|---|
| A | Slide Breech Face |
| B | Slide |
| C | Projectile |
| D | Barrel |
| E | Gas Inlet |
| F | Gas Tube |
| G | Recoil Spring |
| H | Piston Head |
| I | Piston Extension |
| J | Barrel Bore |
| K | Piston |
| L | Cartridge case |
| M | Receiver |
| N | Operating Rod |
| O | Recoil Spring Cover |
| P | Travel Stop Damper |
| Q | Piston Gas Seal |
| R | Rifle bolt |

FIGS. 2-6 and 8-13 show cutaway diagrams of interior components of an example upper receiver 200 including an example gas piston recoil damping assembly 202, according to an embodiment. The damping assembly 202 includes the gas tube (F), the gas inlet (E), the piston (K) that is positioned within the gas tube (F), the piston head (H), the piston extension (I), and the recoil spring (G). In other embodiments, the damping assembly 202 may include fewer, additional, or alternative components, and have a similar or same function.

As shown in FIGS. 3-6 and 8-14, the damping assembly 202 can also include a recoil spring cover (O). In other embodiments, other components may also be present. For instance, in some embodiments, a travel stop damper (P) may also be disposed at one or more locations near the front end of the piston (K) or the piston head (H).

FIGS. 2, 3, 5, and 8 are illustrated to show an implementation of a handgun or other firearm having a slide (B), and FIGS. 4, 6, and 9-13 are illustrated to show an implementation of a rifle, or like firearm having a bolt (R).

As shown in FIGS. 2, 3, 5, and 8 the upper receiver 200 includes (among other components) the slide (B) and the barrel (D). The barrel (D) is positioned within the slide (B), and protrudes from an opening (S) in the slide (B), while the slide (B) is capable of moving independently of the barrel (D). In other words, the slide (B) and the barrel (D) are moveably coupled. As shown in FIGS. 4, 6, 9, 11, and 13, the upper receiver 200 includes (among other components) the bolt (R), the barrel (D), a sliding mechanism (T), and the operating rod (N). The barrel (D) is positioned within the sliding mechanism (T), which is coupled to the operating rod (N), which is coupled to the bolt (R). In other words, the bolt (R) and the barrel (D) are moveably coupled (via the operating rod (N) and the sliding mechanism (T)).

In each of the implementations, the gas tube (F) may be integral with or fixed to the barrel (D) (or receiver 200 housing, etc.) however the piston (K) is arranged to move with movement of the slide (B) or the operating rod (N)/sliding mechanism (T). The piston extension (I) protrudes through another opening in the slide (B) or is coupled to another portion of the upper receiver 200, keeping the motion of the piston (K) in a preset alignment. The piston (K) moves within the gas tube (F) when the slide (B) moves or when the operating rod (N)/sliding mechanism (T) moves. The piston (K) includes one or more gas seals (Q) that form a seal within the gas tube (F). The interior of the gas tube (F) has access to the barrel bore (J) through the gas inlet (E).

The recoil spring (G) is disposed surrounding the gas tube (F) and the piston (K), coaxial with the gas tube (F) and the piston (K). In an alternative embodiment, the recoil spring (G) may be disposed parallel to the gas tube (F) and the piston (K). One end of the recoil spring (G) is disposed at the base of the gas tube (F) and the other end of the spring (G) is disposed at the piston head (H). Thus, the recoil spring (G) compresses and expands with the movement of the piston (K) and the slide (B) or operating rod (N)/sliding mechanism (T). In other words, the recoil spring (G) and the piston (K) resist the movement of the slide (B) or operating rod (N)/sliding mechanism (T) according to the spring constant of the recoil spring (G) and the pressure within the gas tube (F) acting against the piston (K).

Example Operation

Figure 2:
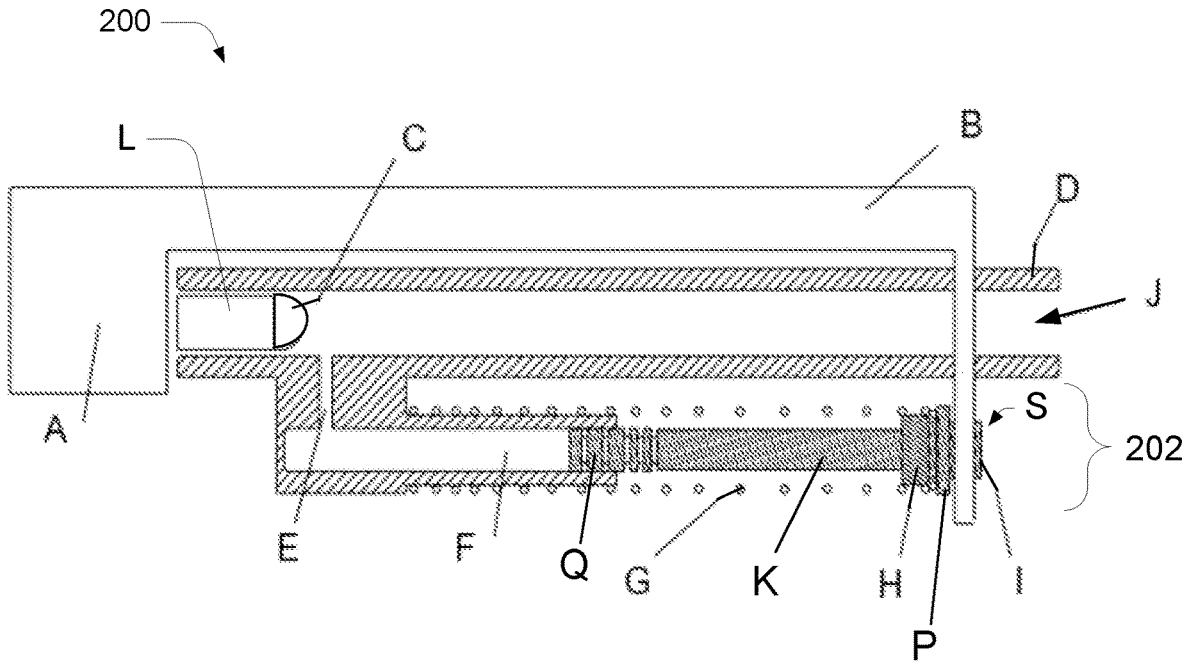
FIG. 2 shows a right side cross-section diagram of an example upper receiver assembly including an example gas piston damping assembly, according to an embodiment.
Figure 3:
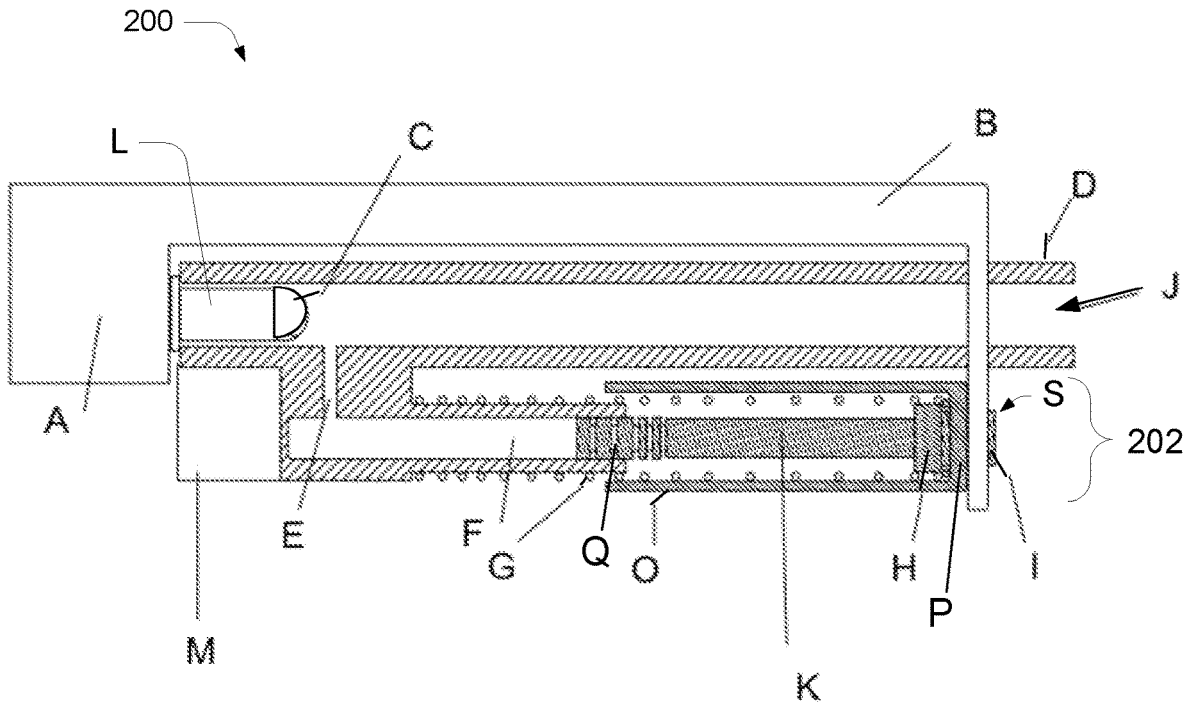
FIG. 3 shows a right side cross-section diagram of an example upper receiver assembly including an example gas piston damping assembly prior to triggering, according to an embodiment.
Figure 4:
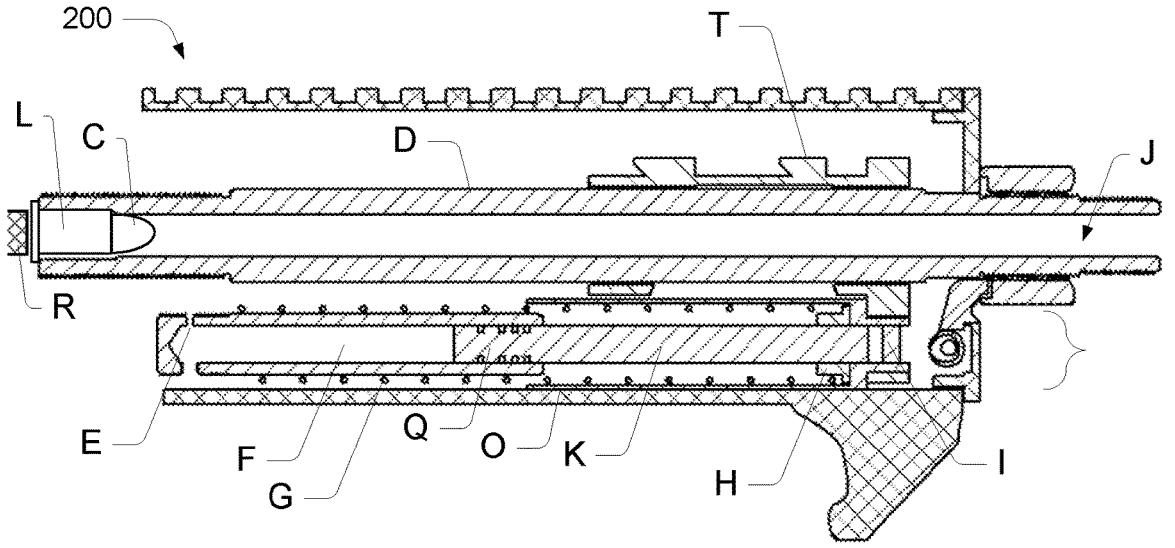
FIG. 4 shows a right side cross-section diagram of an example upper receiver assembly including an example gas piston damping assembly prior to triggering, according to another embodiment.

Referring to FIGS. 2-4, a projectile (C) (shown within a cartridge casing L) is shown in the firing chamber of the upper receiver 200, or in other words, within the barrel bore (J) at the breech end of the barrel (D). The breech face (A)

of the slide (B) or bolt (R) is positioned against the breech end of the barrel (D), and holds the cartridge case (L) in firing position. In the rifle (e.g., FIG. 4), the bolt (R), which is coupled to the operating rod (N) is positioned against the breech end of the barrel (D) or the barrel extension, and is tight against the cartridge case (L) in a like manner.

When the firearm is triggered, the fuel in the cartridge case (L) detonates and creates rapidly expanding high-pressure gases. The gases expand within the cartridge case (L) behind the projectile (C), forcing the projectile (C) from the cartridge case (L) and into the barrel's bore (J).

Figure 7:
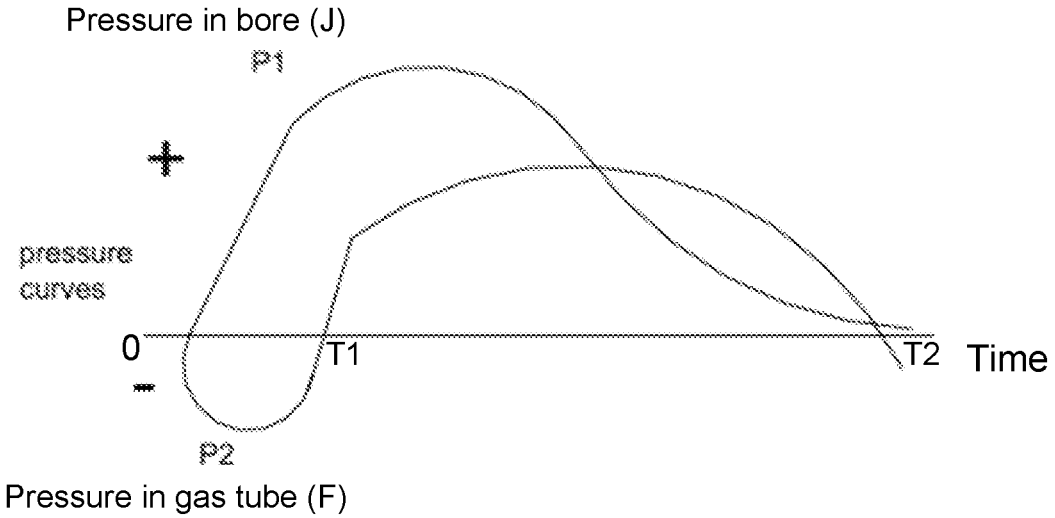
FIG. 7 shows two example pressure curves of an example automatic firearm, according to an embodiment.

After the projectile (C) is expelled from the cartridge case (L), the pressure in the bore (J) continues to build, as shown by the pressure curve P1 at FIG. 7. During this time, the pressure within the gas tube (F) may be negative, as shown by the pressure curve P2.

Figure 5:
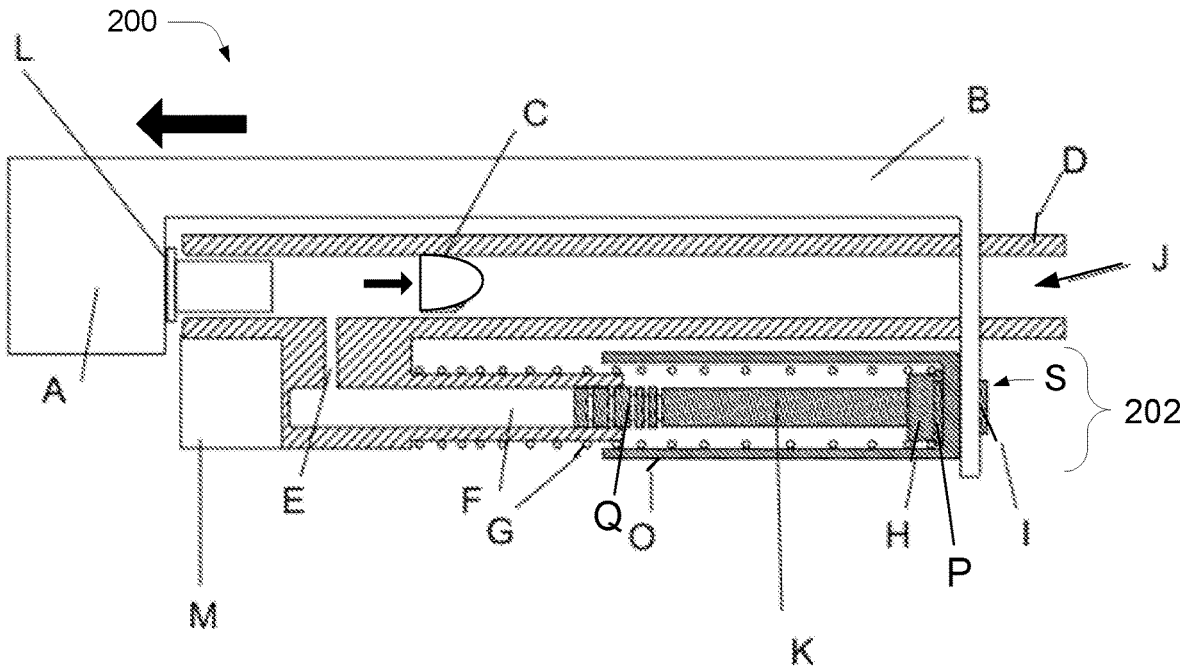
FIG. 5 shows a right side cross-section diagram of an example upper receiver assembly including an example gas piston damping assembly just after triggering, according to an embodiment.
Figure 6:
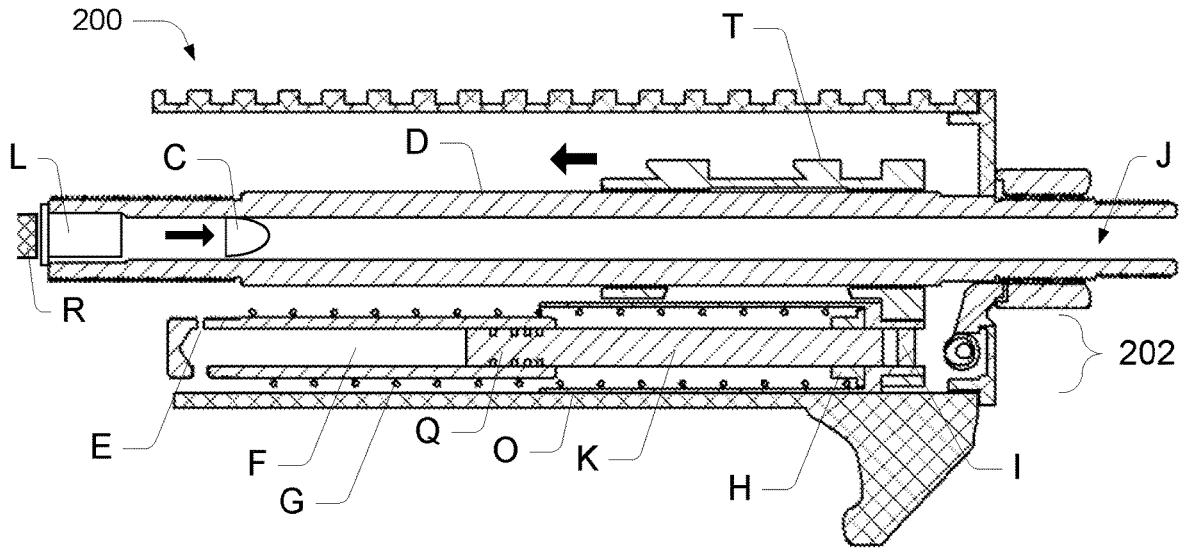
FIG. 6 shows a right side cross-section diagram of an example upper receiver assembly including an example gas piston damping assembly just after triggering, according to another embodiment.

Referring to FIGS. 5 and 6, after the projectile (C) is forced from the cartridge case (L) and begins to move down the barrel bore (J), the high gas pressure breaks the bond between the cartridge case (L) and the chamber wall of the barrel bore (J) and the breech face (A) of the slide (B) (see FIG. 5) or the bolt (R) in the case of a rifle (see FIG. 6). This movement performs primary extraction, while moving the cartridge case (L) and the slide (B) or the bolt (R) and operating rod (N) backward a fraction of an inch. The high-pressure gas flows through the gas inlet (E) and into the gas tube (F), charging the gas tube (F) as shown at the pressure curve P2 at time (T1) (see FIG. 7).

As the projectile (C) continues to move down the barrel bore (J) from the expanding gas pressure, the gas pressure also pushes against the slide (B) or the bolt (R), attempting to move the slide (B) or the bolt (R)/operating rod (N)/sliding mechanism (T) rearward relative to the barrel (D). However, the gas pressure equalizes in the barrel bore (J) and the gas tube (F), which holds the action closed and retards the reward movement of the slide (B) or the bolt (R)/operating rod (N)/sliding mechanism (T) relative to the barrel (D). This is because the slide (B) is coupled to the piston (K) and the sliding mechanism (T) is coupled to the piston (K) and the piston (K) is held in the open/expanded position by the gas pressure in the gas tube (F) (along with the force of the recoil spring (G)).

Figure 10:
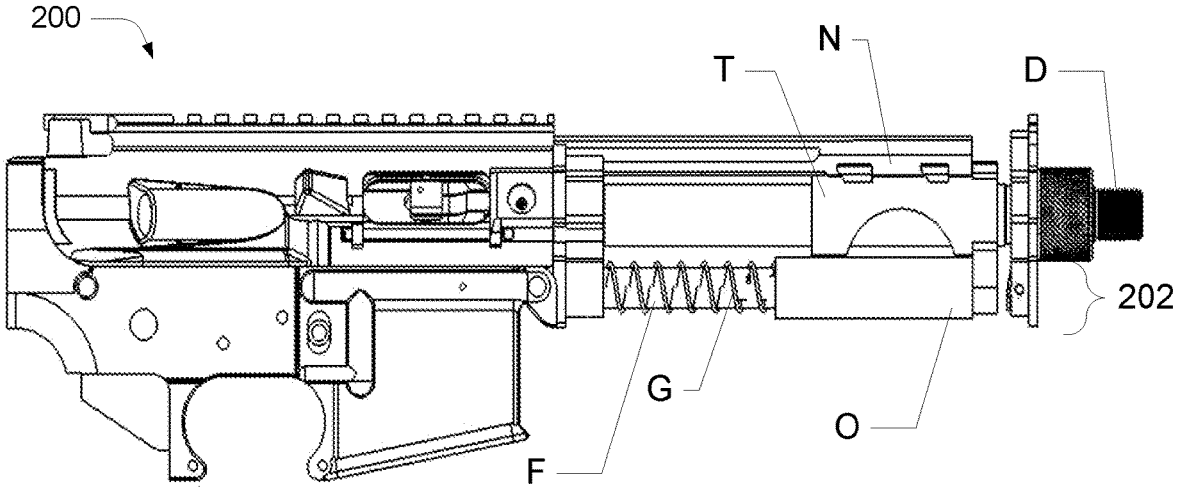
FIG. 10 shows a right side view of an example automatic firearm including an example gas piston damping assembly in a first position, according to an embodiment.
Figure 11:
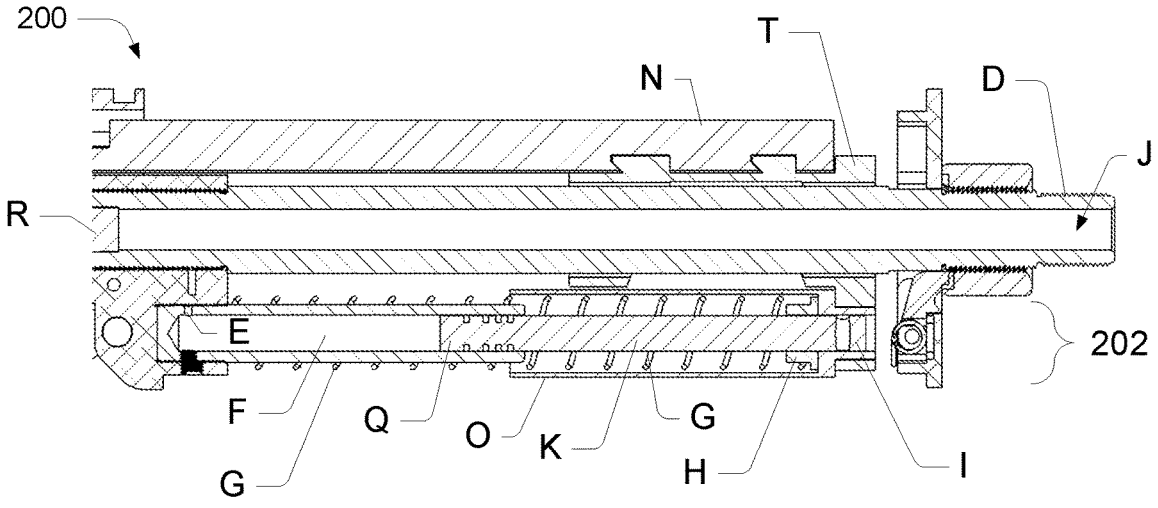
FIG. 11 shows a right side cut-away view of the example automatic firearm of FIG. 10, according to an embodiment.

In other words, the rearward force on the slide (B) or the bolt (R)/operating rod (N)/sliding mechanism (T) acts on the piston head (H) causing the piston (K) to compress the gas in the gas tube (F). The compressed gas in the gas tube (F) pushes back against the piston (K) as it tries to move with the slide (B) or bolt (R), which slows or stops the movement of the slide (B) or the bolt (R)/operating rod (N)/sliding mechanism (T) relative to the barrel (D). The rearward movement of the slide (B) or the bolt (R)/operating rod (N)/sliding mechanism (T) is also slowed by the compression of the recoil spring (G). As shown at FIGS. 5 and 6, the damping assembly 202 is in the first (open/expanded) position or configuration relative to the barrel (D). This first position is also shown in the illustrations of FIGS. 10 and 11 with respect to an example rifle.

Referring also to FIG. 7, as the projectile (C) moves down the barrel bore (J), the gas pressure P1 behind the projectile (C) eventually drops. The gas in the gas tube (F) may also diminish somewhat but continues to be compressed by the piston (K), which continues to slow the movement of the slide (B) or the bolt (R)/operating rod (N)/sliding mechanism (T). When the projectile (C) exits the barrel bore (J) the gas pressure in the bore (J) drops quickly from a positive value to a low or negative pressure value, which draws the remaining gas from the gas tube (F) as shown at time (T2) in FIG. 7.

Figure 8:
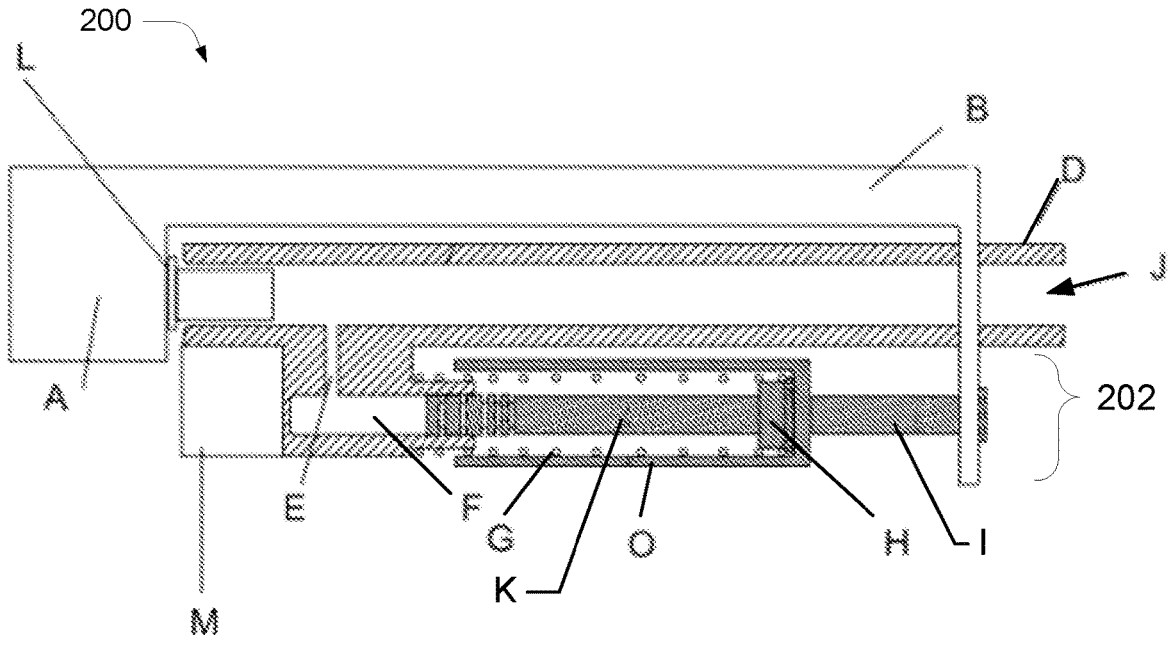
FIG. 8 shows a right side cross-section diagram of an example automatic firearm including an example gas piston damping assembly after triggering, according to an embodiment.
Figure 9:
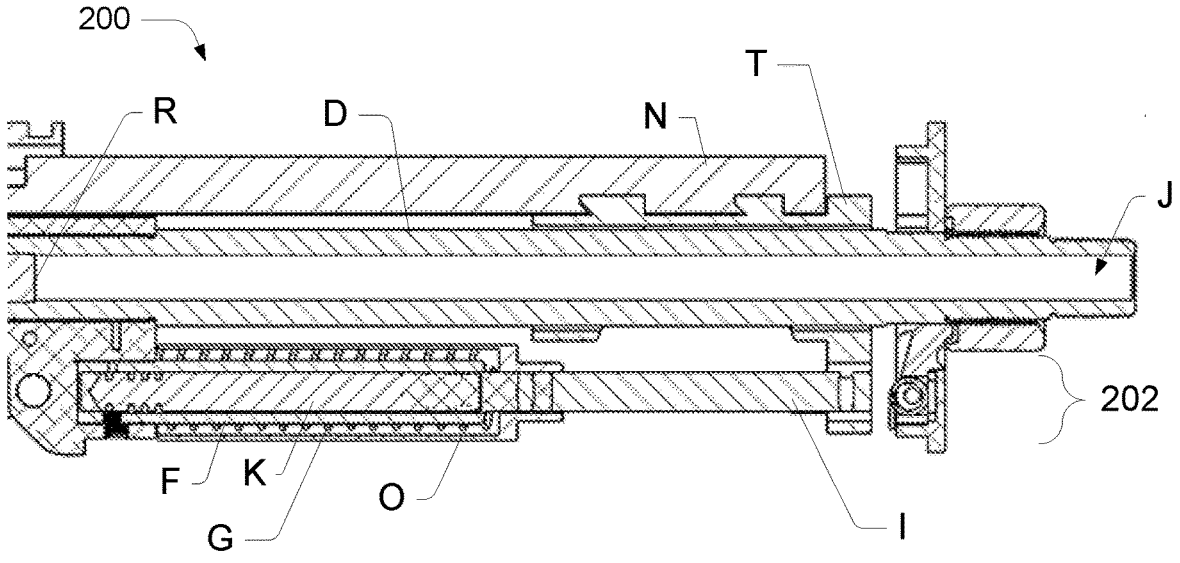
FIG. 9 shows a right side cross-section diagram of an example upper receiver assembly including an example gas piston damping assembly after triggering, according to another embodiment.
Figure 12:
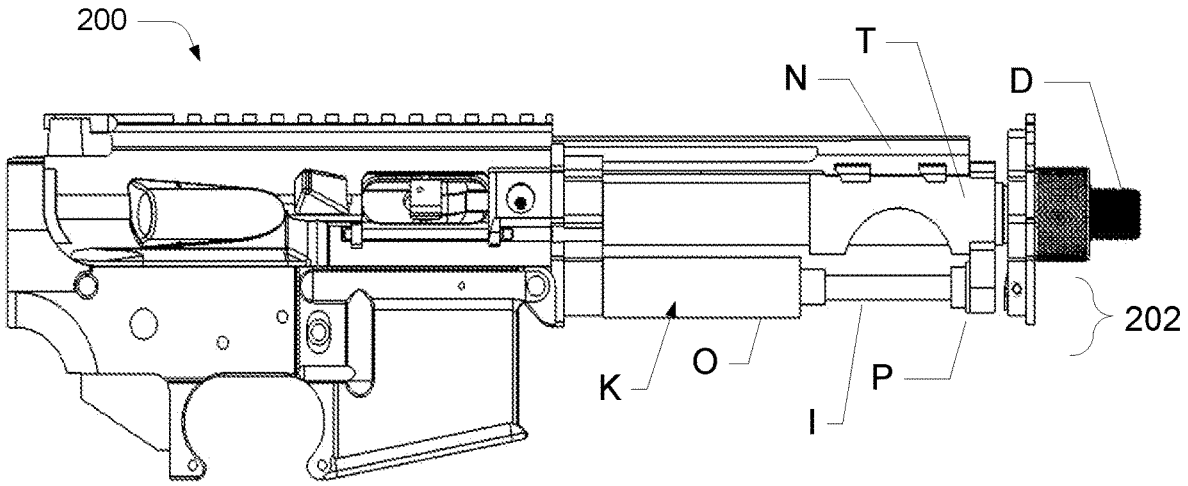
FIG. 12 shows a right side view of an example automatic firearm including an example gas piston damping assembly in a second position, according to an embodiment.
Figure 13:
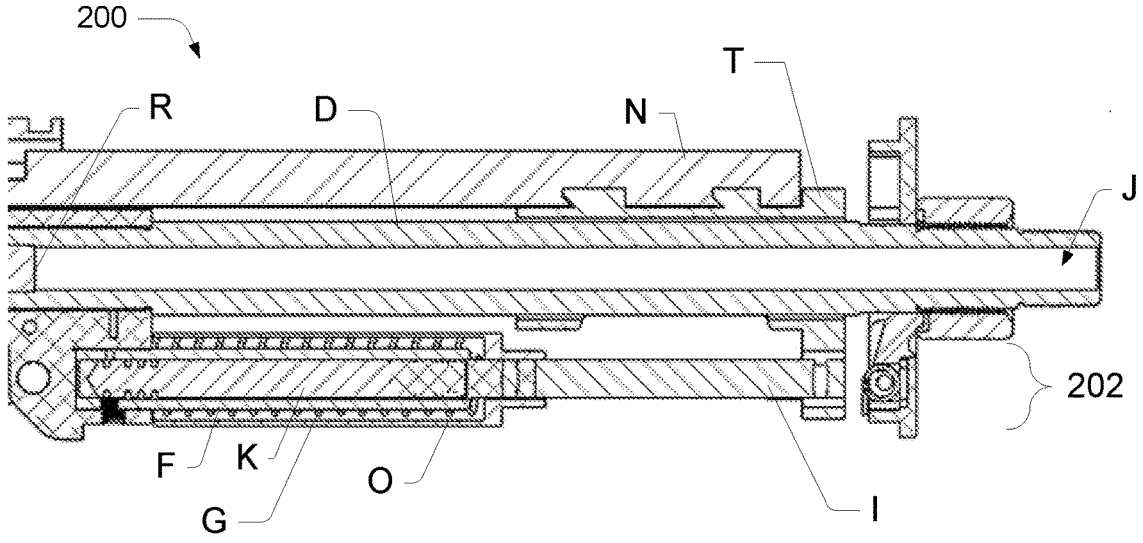
FIG. 13 shows a right side cut-away view of the example automatic firearm of FIG. 12, according to an embodiment.

Referring to FIGS. 8 and 9, with low or no gas pressure or a negative pressure in the gas tube (F), the piston (K) is allowed to travel to the bottom of the gas tube (F), compressing the recoil spring (G) and moving into the closed/compressed configuration (see also FIGS. 12 and 13). The slide (B) or the bolt (R)/operating rod (N)/sliding mechanism (T) is allowed to move against the full compression of the recoil spring (G), as the slide (B) or the bolt (R)/operating rod (N)/sliding mechanism (T) is pushed backward relative to the barrel (D) by the force of the previous detonation.

Thus, the action is allowed to cycle fully and will return to an open/expanded position by the expansion of the recoil spring (G). The completed cycle returns the damping assembly 202 to the first configuration with the piston (K) fully extended and the recoil spring (G) fully expanded, as shown at FIGS. 5, 6, 10, and 11. The sequence repeats with the next triggering event.

As will be appreciated by those having skill in the art, the timing of the various stages described above is not trivial. The sequence of events have a very precise timing with respect to each stage that is critical for the desired operation. The timing can be fine-tuned or adjusted by making adjustments to the recoil spring (G) and/or adjustments to the gas tube (F)/piston (K) components. For example, the recoil spring (G) may be selected based on the spring constant of the spring (G). To increase the speed of the cycle action, a spring (G) with a lighter spring constant may be selected. Conversely, to further slow the cycle action, a spring (G) with a greater spring constant may be selected.

Alternately or additionally, the gas tube (F)/piston (K) components may be fine-tuned or adjusted for desired operation. For example, the size of the gas inlet (E) controls the speed of charging and discharging the gas tube (F), which includes controlling the instantaneous pressure in the gas tube (F) when the piston (K) is compressing the gas in the tube (F). The volume of the gas tube (F), along with the size of the gas inlet (E) controls the amount of gas pressure available to push back against the piston (K) at the various stages discussed. To increase the speed of the cycle action, the diameter of the inlet tube (E) may be increased and/or the volume of the gas tube (F) may be decreased. Conversely, to further slow the cycle action, the diameter of the inlet tube (E) may be decreased and/or the volume of the gas tube (F) may be increased. However, the inlet tube (E) has a minimum possible diameter in order to charge and discharge the gas tube (F) within the fractions of a second that it takes for the projectile (C) to travel the length of the bore (J).

In some embodiments, a travel stop damper (P) may be disposed at the front end of the piston head (H). The travel stop damper (P) can include a collar or cushion comprised of a compressible material (e.g., urethane, polypropylene, Teflon™, etc.). Positioned between the piston head (H) and the slide (B), between the piston head (H) and the inside of the recoil spring cover (O), and/or between the outside surface of the recoil spring cover (O) and the slide (B), the travel stop damper (P) can reduce the impact of the piston head (H) on the slide (B) during cycling, and therefore reduce wear to these components and their connected components.

Another location for a travel stop damper (P) can be between the recoil spring (G) and the recoil spring cover (O), providing a softer impact point for the moving parts of the action components and preventing erratic cycling and impact damage.

In another embodiment, the piston head (H) can be made from a damping material as well. The piston head (H) stops the rearward movement of the piston as it impacts the front of the gas tube (F). Making the piston head (H) from a damping material can prevent the operation rod (N), the slide (B), or any other related component from impacting other parts of the firearm, preventing repetitive impact damage.

Disassembly and Assembly

The damping assembly 202 may be removed and installed as a unit. To remove the damping assembly 202 (e.g., to disassemble the firearm), push the recoil spring cover (O) linearly toward the rear portion of the receiver (M) of the firearm, compressing the recoil spring (G), which moves the attached piston (K) as one unit. As the end of the piston (K) is moved linearly in combination with the recoil spring cover (O) and the recoil spring (G), the piston (K) is pushed into the gas cylinder (F). The end of the piston extension (I) can be withdrawn from the opening (R) of the slide (B), allowing the slide (B) to be removed from the firearm (M).

In rifle applications (e.g., FIGS. 10-13), the gas tube (F) can be rotated from the operational rod (N) and the components of the damping assembly 202 can slide out the front of the firearm. In embodiments where the system is used with a semi-automatic handgun, the components of the damping assembly 202 can slide out the front of the handgun as a single unit. The process is reversed to install the damping assembly 202 and to assemble the firearm.

Because the gas tube (F) is integral to the barrel (D) or firmly fixed to the barrel (D), there is added rigidity for better alignment between the barrel (D) and the cycle action components: the piston (K) and the recoil spring (G). This added rigidity keeps everything inline during cycling, reducing wear on the moving components.

Representative Process

Figure 14:
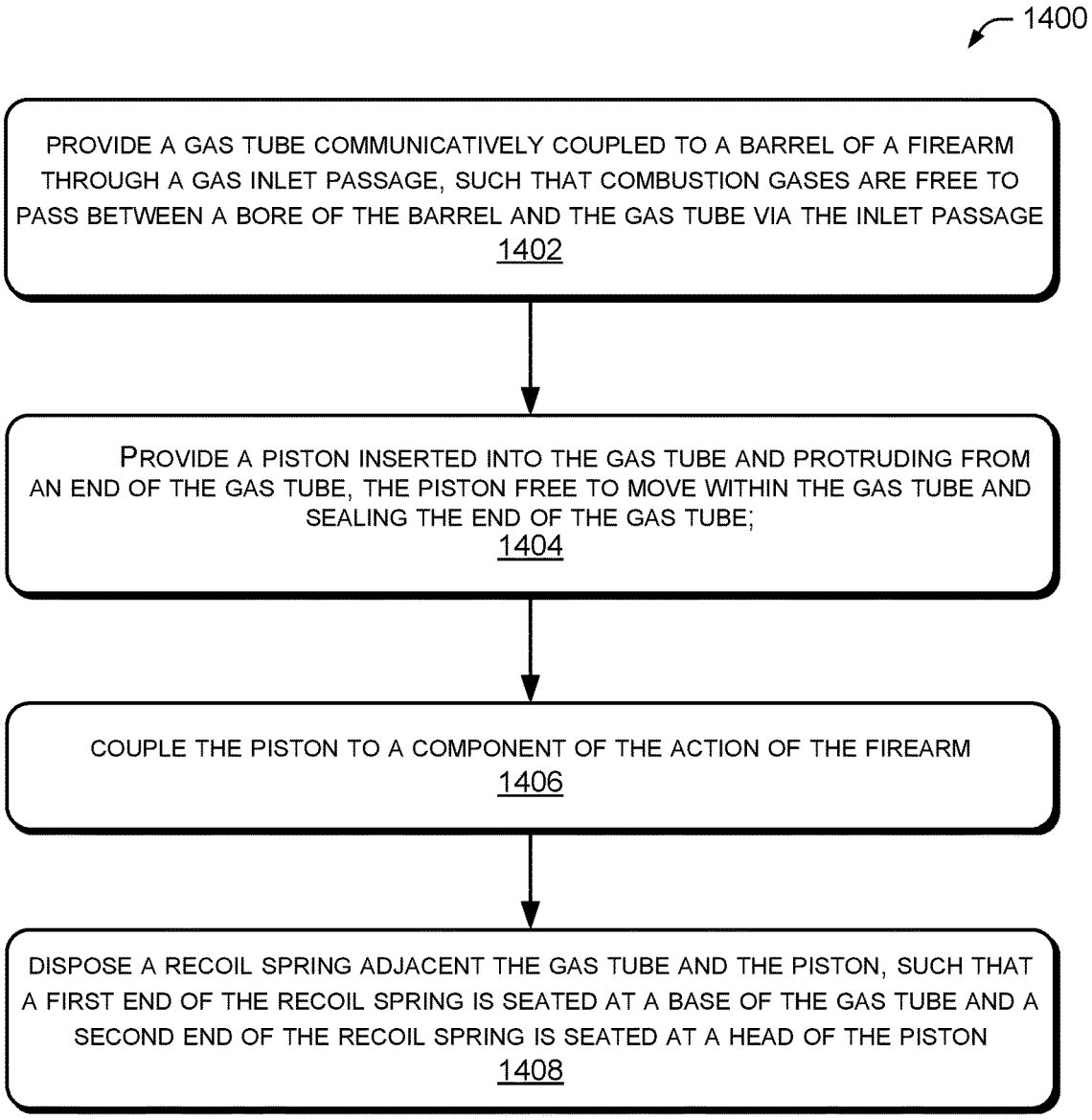
FIG. 14 is a flow diagram illustrating an example process of controlling a cycle rate of a firearm, according to an implementation

FIG. 14 illustrates a representative process 1400 for implementing techniques and/or devices relative to controlling the cycle rate of an automatic or semiautomatic firearm, according to various embodiments. The system includes a damping assembly (such as damping assembly 202, for example) formed from at least a gas piston (such as gas piston (K), for example) and a recoil spring (such as recoil spring (G), for example). The example process 1400 is described with reference to FIGS. 1-13.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable hardware, software, firmware, or a combination thereof, without departing from the scope of the subject matter described herein.

At block 1402, the process includes providing a gas tube communicatively coupled to a barrel of a firearm through a gas inlet passage, such that combustion gases are free to pass between a bore of the barrel and the gas tube via the inlet passage.

At block 1404, the process includes providing a piston inserted into the gas tube and protruding from an end of the gas tube, the piston free to move within the gas tube and sealing the end of the gas tube.

At block 1406, the process includes coupling the piston to a component of the action of the firearm. In some examples, the component of the firearm comprises a slide of a handgun style firearm or a bolt of a rifle style handgun. The piston may be coupled to the slide or the bolt directly or via one or more other components, such that the slide or the bolt is constrained to move (or to not move) with the piston. In other words, the slide or bolt moves when the piston moves and does not move when the piston does not move.

At block 1408, the process includes disposing a recoil spring adjacent the gas tube and the piston, such that a first end of the recoil spring is seated at a base of the gas tube and a second end of the recoil spring is seated at a head of the piston. In an embodiment, the recoil spring is disposed surrounding the piston and the gas tube.

In various examples, the process includes damping movement of the action of the firearm by pressurizing the gas tube with the combustion gases, via the inlet passage. Further, the process includes adjusting the damping and a cycle timing of the firearm by adjusting a size of the inlet passage.

In an example, the process includes delaying movement of the piston by pressurizing the gas tube, and thereby delaying movement of the component of the action.

In alternate implementations, other techniques may be included in the process in various combinations, and remain within the scope of the disclosure. Although various implementations and examples are discussed herein, further implementations and examples may be possible by combining the features and elements of individual implementations and examples.

The subject matter of the present disclosure is described with specificity to meet statutory requirements. However, the description itself is not intended to limit the scope of this disclosure. Rather, the claimed or disclosed subject matter might also be embodied in other ways to include different components, steps, or combinations thereof similar to the ones described in this document, in conjunction with other present or future technologies. Terms should not be interpreted as implying any particular order among or between various steps disclosed herein unless and except when the order of individual steps is explicitly described. For purposes of this disclosure, the word "including" has the same broad meaning as the word "comprising." In addition, words such as "a" and "an," unless otherwise indicated to the contrary, include the plural as well as the singular. Thus, for example, the constraint of "a feature" is satisfied where one or more features are present. Also, the term "or" includes the conjunctive, the disjunctive, and both (a or b thus includes either a or b, as well as a and b).

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A damping assembly for a firearm, comprising:

a gas tube communicatively coupled to a barrel of a firearm through a gas inlet passage, such that gases are free to pass between a bore of the barrel and the gas tube via the inlet passage;

a piston inserted into the gas tube and protruding from an end of the gas tube, the piston free to move within the gas tube and sealing the end of the gas tube, and wherein the piston is coupled to a component of the action of the firearm; and a recoil spring disposed surrounding the gas tube and the piston, a first end of the recoil spring seated at a base of the gas tube and a second end of the recoil spring seated at a head of the piston.

2. The damping assembly for a firearm of claim 1, further comprising a cover disposed around the piston and around at least a portion of the recoil spring that is disposed around the piston.

3. The damping assembly for a firearm of claim 2, further comprising a travel stop damper comprising a cushioning component disposed between the piston and a slide of the firearm, between the piston and an inside of the cover, and/or or between an outside surface of the cover and the slide.

4. The damping assembly for a firearm of claim 1, wherein the gas tube is integral to or coupled to the barrel of the firearm.

5. The damping assembly for a firearm of claim 1, wherein the gas tube, the piston, and the recoil spring are arranged parallel to the barrel.

6. The damping assembly for a firearm of claim 1, wherein the gas tube, the piston, and the recoil spring are coaxial.

7. The damping assembly for a firearm of claim 1, wherein the piston is coupled to a slide of the firearm such that the slide moves with the piston.

8. The damping assembly for a firearm of claim 7, wherein the piston prevents the slide from moving when the gas tube is pressurized, preventing the piston from moving.

9. The damping assembly for a firearm of claim 1, wherein the piston is coupled to a bolt of the firearm via an operating rod, such that the bolt moves with the piston.

10. The damping assembly for a firearm of claim 9, wherein the piston prevents the bolt from moving when the gas tube is pressurized, preventing the piston from moving.

11. The damping assembly for a firearm of claim 1, wherein an extension of the piston protrudes through a slide of the firearm, maintaining an alignment of the piston and the recoil spring with respect to the slide and to the barrel.

12. The damping assembly for a firearm of claim 1, wherein high-pressure gases within the barrel during a triggering event also fill the gas tube, and restrain the movement of the component of the action for a predetermined duration.

13. The damping assembly for a firearm of claim 12, wherein a low pressure within the barrel at a predetermined time after the triggering event evacuates gases from the gas tube and allows the piston and the component of the action to move, which compresses the recoil spring.

14. A damping assembly for a firearm, comprising:

a gas tube communicatively coupled to a barrel of a firearm through a gas inlet passage, such that gases are free to pass between a bore of the barrel and the gas tube via the inlet passage;

a piston inserted into the gas tube such that a first end of the piston protrudes from an end of the gas tube, the piston being free to move within the gas tube and sealing the end of the gas tube with a second end of the piston, and wherein the first end of the piston is coupled to a slide or a bolt of the firearm such that the slide or the bolt is constrained to move with the piston; and a recoil spring disposed surrounding the gas tube and the piston, a first end of the recoil spring seated at a base of the gas tube and a second end of the recoil spring seated at a head of the piston, such that movement of the piston into the gas tube compresses the recoil spring and expansion of the recoil spring pushes the piston out of the gas tube.

15. A method, comprising:

providing a gas tube communicatively coupled to a barrel of a firearm through a gas inlet passage, such that combustion gases are free to pass between a bore of the barrel and the gas tube via the inlet passage;

providing a piston inserted into the gas tube and protruding from an end of the gas tube, the piston free to move within the gas tube and sealing the end of the gas tube;

coupling the piston to a component of the action of the firearm; and disposing a recoil spring surrounding the gas tube and the piston, such that a first end of the recoil spring is seated at a base of the gas tube and a second end of the recoil spring is seated at a head of the piston.

16. The method of claim 15, further comprising damping movement of the action of the firearm by pressurizing the gas tube with the combustion gases, via the inlet passage.

17. The method of claim 15, further comprising adjusting the damping and a cycle timing of the firearm by adjusting a size of the inlet passage.

18. The method of claim 15, further comprising delaying movement of the piston by pressurizing the gas tube, and thereby delaying movement of the component of the action.

19. The method of claim 15, further comprising disposing a cover to surround the gas tube and the piston.

20. The method of claim 15, wherein the component of the action of the firearm comprises a slide or a bolt.

* * * * *